US006798865B2

(12) United States Patent
Tang

(10) Patent No.: US 6,798,865 B2
(45) Date of Patent: Sep. 28, 2004

(54) HV SYSTEM FOR A MONO-POLAR CT TUBE

(75) Inventor: Liang Tang, Waukesha, WI (US)

(73) Assignee: GE Medical Systems Global Technology, Waukesha, WI (US)

( * ) Notice: Subject to any disclaimer, the term of this patent is extended or adjusted under 35 U.S.C. 154(b) by 168 days.

(21) Appl. No.: 10/294,857

(22) Filed: Nov. 14, 2002

(65) Prior Publication Data

US 2004/0094326 A1 May 20, 2004

(51) Int. Cl.[7] ..... H01B 7/00; H01I 35/00

(52) U.S. Cl. ..... 378/119; 378/142; 174/138 F

(58) Field of Search ..... 378/119, 125, 378/136, 128, 142, 144; 174/138 F, 138 R, 152 G, 65 G, 602; 439/602

(56) References Cited

U.S. PATENT DOCUMENTS

| | | | | |
|---|---|---|---|---|
| 4,073,426 A | | 2/1978 | Devine, Jr. | |
| 4,079,687 A | | 3/1978 | Mentcher | |
| 4,195,247 A | | 3/1980 | Hirsch | |
| 4,276,493 A | | 6/1981 | Srinivasa | |
| 4,481,655 A | | 11/1984 | Annis | |
| 4,685,173 A | * | 8/1987 | Pavur | 16/2.2 |
| 4,802,196 A | | 1/1989 | Tiearney | |
| 4,876,705 A | | 10/1989 | Delair | |
| 4,945,562 A | | 7/1990 | Staub | |
| 4,972,193 A | | 11/1990 | Rice | |
| 4,972,449 A | | 11/1990 | Upadhya | |
| 4,978,051 A | | 12/1990 | Tiearney | |
| 5,008,918 A | | 4/1991 | Lee | |
| 5,159,619 A | | 10/1992 | Benz | |
| 5,349,626 A | | 9/1994 | Ujari | |
| 5,414,748 A | | 5/1995 | Upadhya | |
| 5,422,527 A | | 6/1995 | Lazzaro | |
| 5,629,970 A | | 5/1997 | Woodruff | |
| 5,689,542 A | * | 11/1997 | Lavering et al. | 378/142 |
| 5,947,758 A | * | 9/1999 | Enck | 439/181 |
| 6,149,301 A | | 11/2000 | Kautzer | |
| 6,198,805 B1 | | 3/2001 | Jambunathan | |
| 6,256,376 B1 | | 7/2001 | Benz | |
| 6,304,631 B1 | | 10/2001 | Snyder | |
| 6,390,876 B2 | | 5/2002 | Benz | |
| 6,421,422 B1 | | 7/2002 | Lifshin | |
| 6,463,125 B1 | | 10/2002 | Minas | |
| 6,584,172 B2 | | 6/2003 | Tiearney | |

* cited by examiner

*Primary Examiner*—Edward J. Glick
*Assistant Examiner*—Hoon Song
(74) *Attorney, Agent, or Firm*—Artz & Artz, PC

(57) ABSTRACT

An HV insulator system for a mono-polar X-ray device includes a top of an insulator including a substantially cone-shaped central portion. A bottom of the insulator defines a flat surface on which the HV contacts are adapted to receive spring loaded pins from HV connectors. A flanged outer edge of the top and bottom is adapted for coupling to an HV connector. The top defines an inverse cone central channel coaxial with the cone-shaped central portion and adapted to receive the HV conductor. The substantially cone-shaped portion further defines the inverse cone channel such that a base of the inverse cone channel is defined at a tapered apex of the substantially cone-shaped central portion.

20 Claims, 6 Drawing Sheets

HV SYSTEM FOR A MONO-POLAR CT TUBE

RELATED APPLICATION

The present invention is related to application entitled "Thermally High Conductive HV Connector For A Mono-Polar Ct Tube" filed simultaneously herewith and incorporated by reference herein.

1. Technical Field

The present invention relates generally to imaging systems and more particularly to an improved apparatus for connecting a high voltage (HV) electric cable to an X-ray tube.

2. Background

Typical rotating anode X-ray tubes include a beam of electrons directed through a vacuum and across a very high voltage (on the order of 100 kilovolts) from a cathode to a focal spot position on an anode. X-rays are generated as electrons strike the anode, which typically includes a tungsten target track, which is rotated at a high velocity.

The conversion efficiency of X-ray tubes is relatively low, i.e. typically less than 1% of the total power input. The remainder is converted to thermal energy or heat. Accordingly, heat removal, or other effective procedures for managing heat, tends to be a major concern in X-ray tube design.

HV electric power cables are typically used to provide the requisite over 100 kilovolt potential difference between the cathode and anode, in order to generate the aforementioned X-rays. One end of the cable is connected to a power source, and the other end is connected to the tube, for connection to the cathode, by means of an HV connector assembly. The connector assembly generally includes a holding structure for maintaining the end of the cable with respect to the tube, such that the end portion of the cable conductors can be joined to a tube. The cable conductors typically include either a single conductor or a number of conductors.

The connector assembly further includes a quantity of HV insulation surrounding any exposed portion of the cable conductors which lie outside the tube. The HV insulation is joined to the X-ray tube and is relatively thick, in relation to the high voltage of the cable conductors.

Generally, high voltage insulating materials, such as epoxy, also tend to be very poor thermal conductors. This creates undesirable results when an HV connector assembly is directly attached to an X-ray tube, such as across an end thereof.

As stated above, a large quantity of heat is generated in the X-ray tube, as an undesired byproduct of X-ray generation. A portion of this heat is directed against the connector insulation materials, which has a comparatively large area contacting the tube. Because of its poor thermal conductive properties, this insulator serves as a heat barrier such that a substantial amount of heat tends to accumulate proximate to the connector. Resultantly, the temperature limits of the connector insulation may be readily exceeded, such that the steady state performance of the X-ray tube is limited.

To improve clinic throughput, X-ray tube designers are facing an ever-increasing demand for more power. Traditionally, CT tubes have included a bi-polar HV system to generate x-ray beams, where a cathode and anode operate at 70 kV under different polarities. A bi-polar HV system typically uses a Federal standard receptacle/plug to bring the HV into the tube casing, where HV connections are made in oil through HV Feedthrough to a tube insert.

HV components within bipolar systems are rated on the order of 70 kV. In an effort to allow more tube peak power, a configuration with mono-polar HV system has been implemented. A mono-polar tube operates at 140 kV with negative polarity and includes a grounded anode electrode.

Mono-polar systems have numerous challenges in terms of HV clearance, discharge activities due to a much higher operating voltage, and constrained dimensions. Conical insulators/plugs have been implemented for such configurations. Several reliability and performance issues have been identified, however, due to thermal stress and material degradation of these conical devices. Conical HV insulation is therefore generally not a viable option for high power tubes.

One of major challenges an HV connector faces is HV integrity under high power conditions. For a continuous high power application, connector temperatures may exceed material limits. Consequently a catastrophic failure may occur through electric breakdown due to thermal runaway or long term discharges from associated material degradation, related to excessive temperatures.

Typical HV solutions often have difficulties handling high temperature scenarios including temperatures in excess of 150° C. Components that include EPR rubber, which is only rated at 105° C. continuously, are of great concern for such applications.

The disadvantages associated with current X-ray systems have made it apparent that a new technique for HV connection to X-ray systems is needed. The new technique should include robust response to thermal stress and should also prevent material degradation. The present invention is directed to these ends.

SUMMARY OF THE INVENTION

In accordance with one aspect of the present invention, an HV insulator system for a mono-polar X-ray device includes a first side of an insulator including a substantially cone-shaped central portion. The second side of the insulator defines an opening coaxial with the cone-shaped central portion and adapted to receive an HV conductor. A flanged outer edge of the first and second sides is adapted for coupling to an HV connector. The first side defines an inverse cone central channel coaxial with the cone-shaped central portion and adapted to receive the HV conductor. The substantially cone-shaped portion further defines the inverse cone channel such that a base of the inverse cone channel is defined at a tapered apex of the substantially cone-shaped central portion.

In accordance with another aspect of the present invention, a method for assembling an HV system for a mono-polar X-ray device includes coupling a ceramic insulator to an X-ray device, where the ceramic insulator includes a first side defining an inverse cone central channel. The first side includes a substantially cone-shaped central portion. The substantially cone-shaped portion further defines the inverse cone channel such that a base of the inverse cone channel is defined at a tapered apex of the substantially cone-shaped central portion. A second side includes an opening, and a flanged outer edge of the first side and the second side. A gasket is compressed between the ceramic insulator and HV connector. A lead-lined HV connector is coupled to the ceramic insulator through spring loaded bolts.

One advantage of the present invention is that the insulator design is such that the insulator has optimal HV performance in terms of preventing surface flashover and bulk breakdown of ceramic.

Additional advantages and features of the present invention will become apparent from the description that follows and may be realized by the instrumentalities and combinations particularly pointed out in the appended claims, taken in conjunction with the accompanying drawings.

BRIEF DESCRIPTION OF THE DRAWING

For a more complete understanding of the invention, there will now be described some embodiments thereof, given by way of example, reference being made to the accompanying drawings, in which.

DETAILED DESCRIPTION

The present invention is illustrated with respect to an HV insulator system, particularly suited to the medical field. The present invention is, however, applicable to various other uses that may require HV insulator systems, as will be understood by one skilled in the art.

Figure 1:
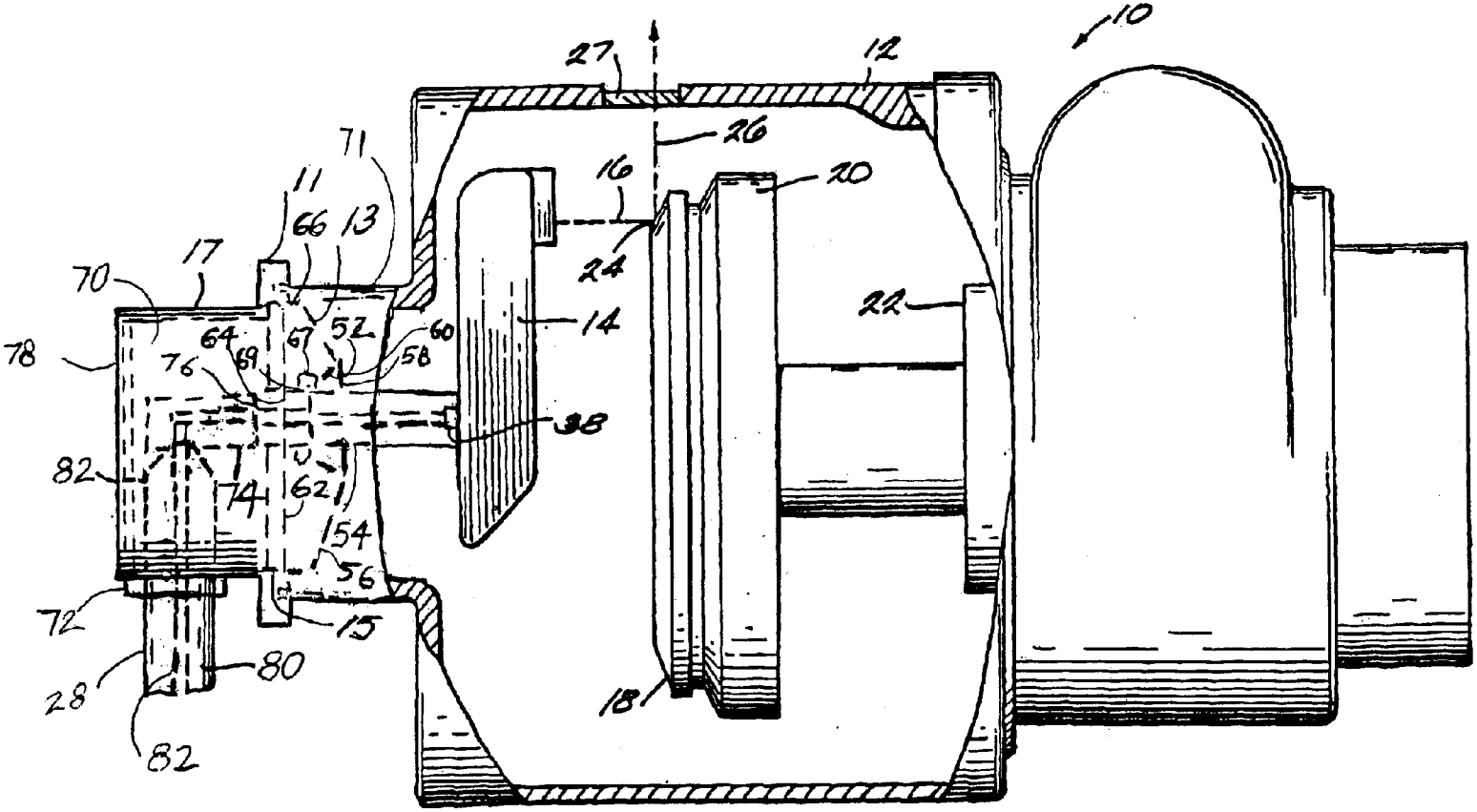
FIG. 1 is a perspective view with a section broken away illustrating an X-ray tube system according to one embodiment of the present invention.

Referring to FIG. 1, an X-ray tube system 10 (X-ray device) including an HV system 11 coupled to a metal housing 12, which supports other X-ray tube components, in accordance with a preferred embodiment of the present invention, is illustrated.

Figure 2:
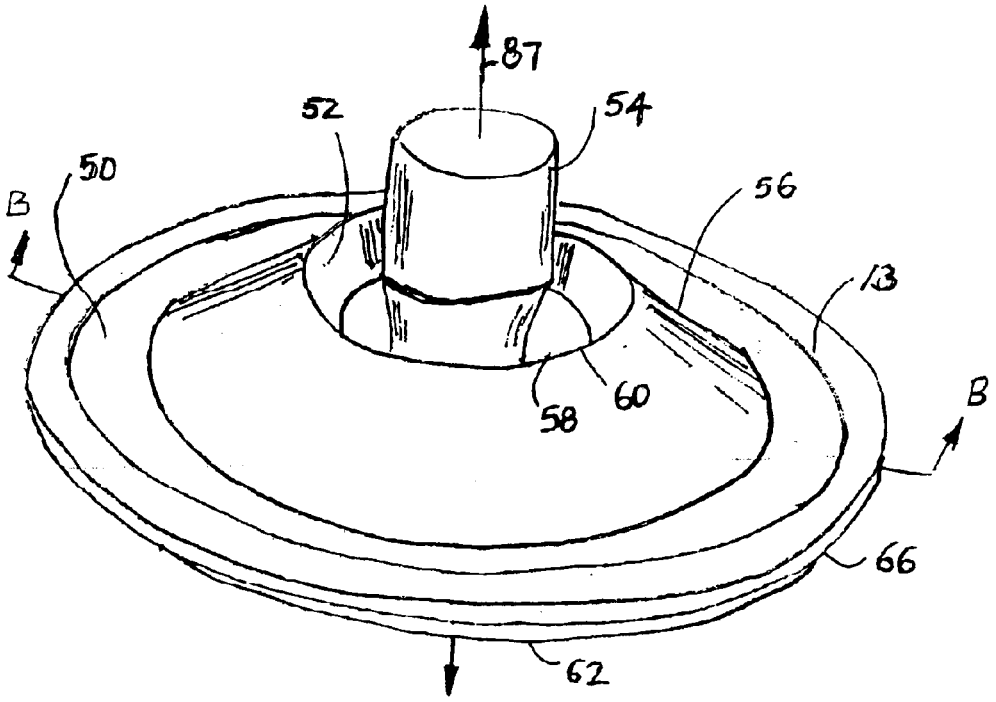
FIG. 2 is a perspective view of an insulator according to FIG. 1.
Figure 2A:
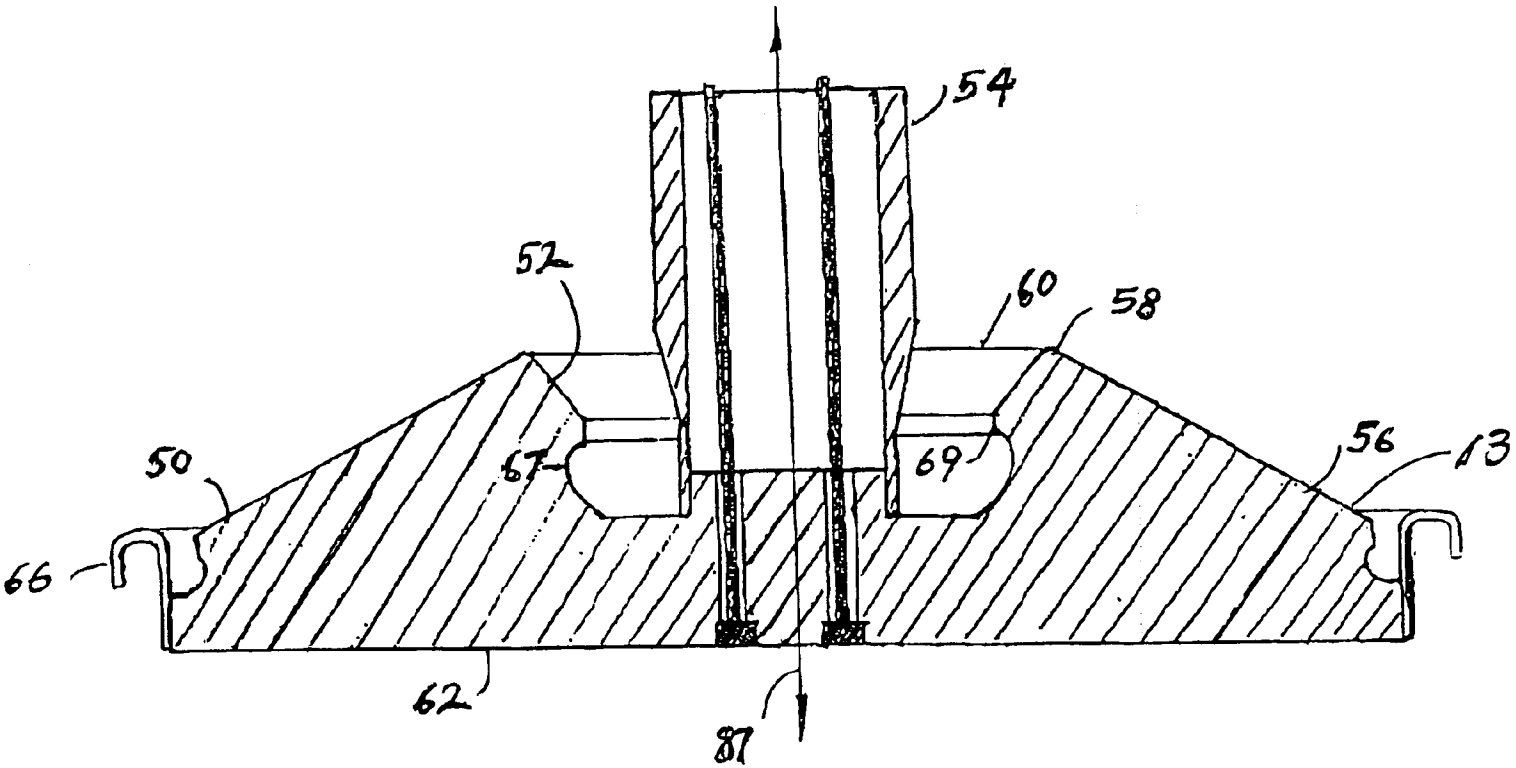
FIG. 2A is a sectional view of an embodiment of the insulator of FIG. 2 in the direction of B—B.
Figure 2B:
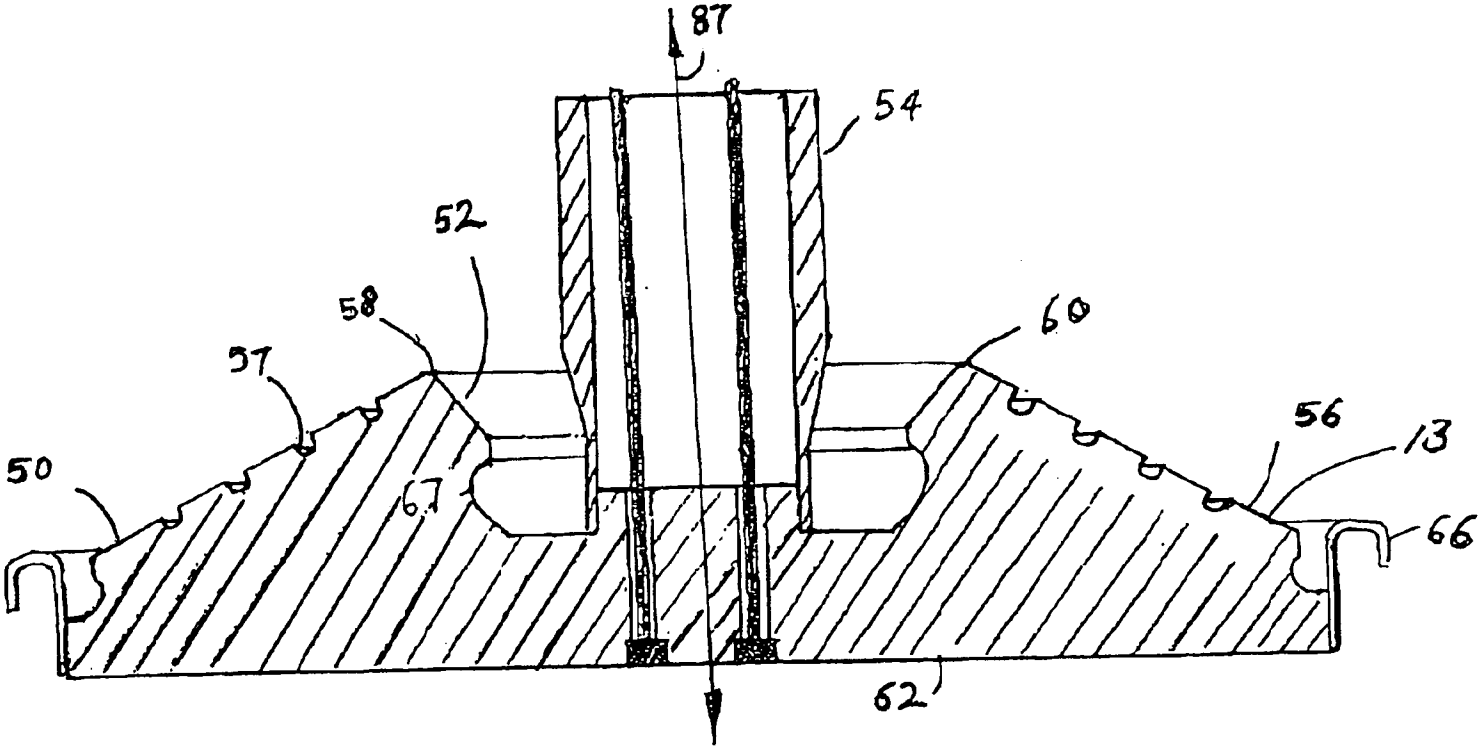
FIG. 2B is an alternate embodiment of FIG. 2A.
Figure 2C:
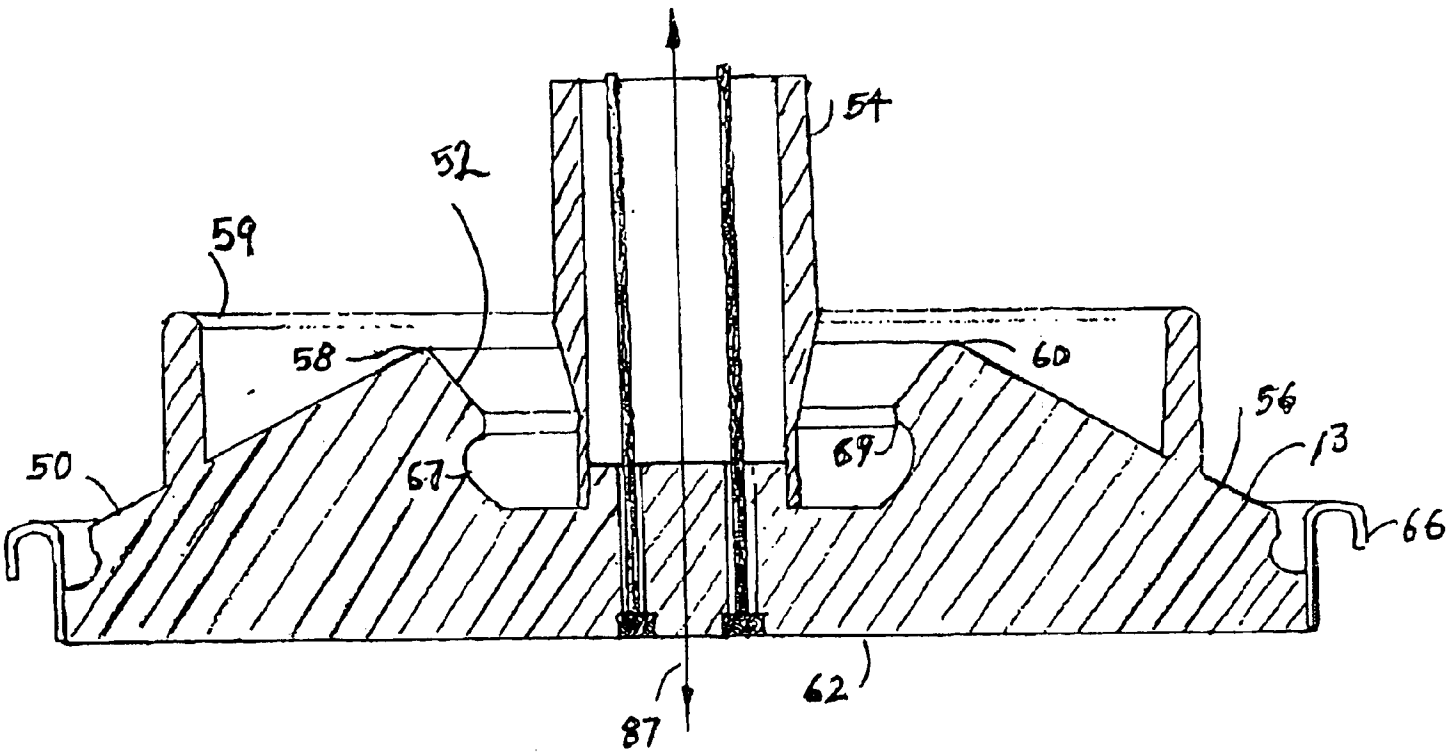
FIG. 2C is an alternate embodiment of FIG. 2A.
Figure 3A:
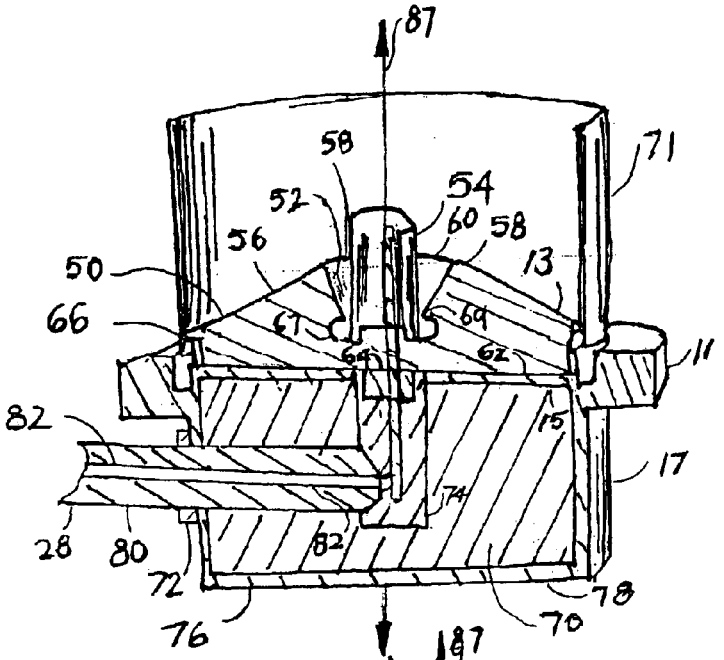
FIG. 3A is a sectional view of FIG. 3 in the direction of A—A.
Figure 3:
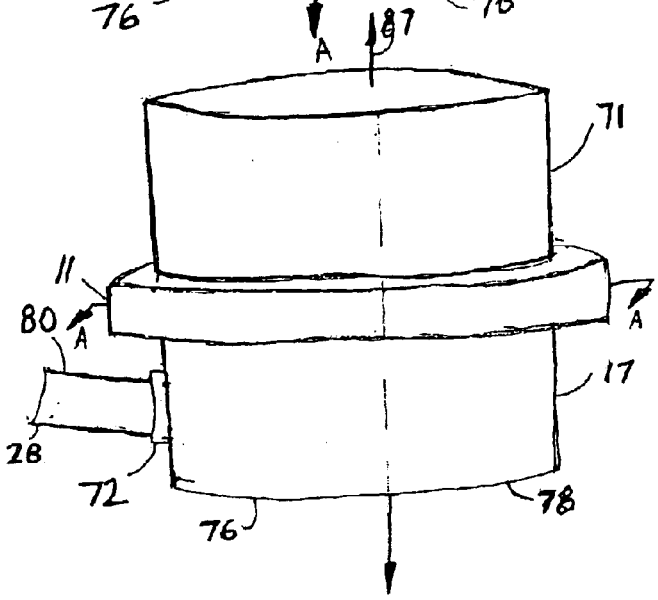
FIG. 3 is a perspective view of the HV connector including the insulator of FIGS. 1 and 2 according to another embodiment of the present invention.

The HV system 11, which includes a ceramic insulator 13, a gasket 15, and an HV connector 17, will be discussed in detail with regards to FIGS. 2, 3 and 3A.

The metal housing 12 includes a cathode 14, and also includes a protective vacuum enclosure for the cathode 14. The cathode 14 directs a high energy beam of electrons 16 onto a target track 18 of an anode 20, which includes a refractory metal disk and is continually rotated by means of a conventional mounting and drive mechanism 22. Target track 18 has an annular or ring-shaped configuration and typically includes a tungsten based alloy integrally bonded to the anode disk 20. As anode 20 rotates, the electron beam from cathode 14 impinges upon a continually changing portion of target track 18 to generate X-rays, at a focal spot position 24. A beam of X-rays 26 generated thereby is projected from the anode focal spot through an X-ray transmissive window 27 provided in the side of housing 12.

In order to generate X-rays as described above, there must be a potential difference on the order of 100 kilovolts between cathode 14 and anode 20. In a mono-polar tube arrangement this is achieved by connecting the anode to a ground (not shown), and applying power at the required 100 kilovolt range to cathode 14 through an electric cable 28. Because of the high voltage carried by cable 28, it is necessary to use the HV connector 17 for coupling the cable to cathode 14.

The HV system 11 includes a ceramic insulator 13 coupled to a gasket 15, which is coupled to an HV connector 17. The embodied HV system includes the aforementioned components coaxial along axis 87, however, numerous other arrangements are included, as will be understood by one skilled in the art.

Referring to FIGS. 1, 2, 2A, 2B, 2C, 3 and 3A, the HV ceramic insulator 13 for the mono-polar X-ray device includes a first side 50 (top side relative to FIG. 2) defining an inverse cone central channel 52, along axis 87, for receiving the HV conductor 54. The first side 50 includes a substantially cone-shaped central portion 56 also along axis 87. The substantially cone-shaped central portion 56 further defines the inverse cone central channel 52 such that a base 58 of the inverse cone channel is defined at a tapered apex 60 of the substantially cone-shaped central portion 56. Alternatives of aforementioned insulator shape profile can also include multiple circumferential grooves 57 as in FIG. 2B or multiple booster sheds 59 on the cone surfaces as in FIG. 2C.

The HV ceramic insulator 13 also includes a second side 62 (bottom side relative to FIG. 2), which is a flat surface which includes HV contacts, which receive spring loaded pins 76 from the HV connector 17 and connect to HV coupling elements 38 through a feedthrough 64. HV conductor 54 is connected to one of contacts. The HV insulator 13 is also embodied with a flanged outer edge 66 of the first side 50 and the second side 62.

In one embodiment, either the first side 50 or the second side 62 further defines a doughnut-shaped area 67 at a tapered apex 69 of the inverse cone channel 52 and coaxial thereto. The doughnut-shaped area 67 is ideally evenly coated with metallization (i.e. a metallization layer). The metallization layer starts from the area immediately next to the HV structure 54 and terminates at the tapered apex 69.

To improve the overall HV stability in a vacuum, the insulator profile is optimized to avoid electric arc creepage. The electric stress at the triple point is minimized through the aforementioned metallization (i.e. the triple point is shifted), thereby mitigating discharge activities. The insulator shape is designed such that the insulator 13 has optimal HV performance in terms of preventing surface flashover and bulk breakdown of ceramic.

The insulator is illustrated within a metal frame 71 and coupled to the connector 17 and coaxial thereto. It is to be understood however that numerous other connectors and ceramic/metal frames are included in the present invention, as will be understood by one skilled in the art.

Referring again to FIGS. 1, 3 and 3A, a slightly-tapered gasket 15 is used for the electrical, thermal, and mechanical reasons. The gasket 15 is embodied as having thin edges and a slightly thicker center, however alternate embodiments include a uniform gasket. The gasket 15 is ideally made of silicone rubber material (or a comparable substitute thereof) and is under compression with a load of 15 to 30 psi when the spring-loaded connector 17 pushes against the flat surface of ceramic insulator 13. The close contact ensures the HV integrity along all interfaces therefore HV performance.

The HV connector 17 includes an epoxy 70, cable terminal 72, shielding device 74, spring-loaded contacts 76, and lead-lined Al housing 78. The HV connector 17 is embodied as cylindrical, however numerous other shapes are included in the present invention, as will be understood by one skilled in the art.

In order to insulate the exposed end portion of conductors 82, that is, the portion extending between the end of insulator 80 and ceramic insulator 13 within tube 10, the HV connector housing 78 is filled with electrical insulating material such as epoxy 70. The epoxy 70 may include fillers such as $Al_2O_3$, or AlN, or BN powders. To further increase the thermal conductivity, the epoxy 70 is alternately loaded with gravels of similar materials. Also, a block of $Al_2O_3$ can be used as part of thermal conduction path as well as HV insulation in epoxy.

The shielding device 74 in the center area (coaxial with axis 87) offers substantial electric field relief around HV conductors and their joints, which reduces the undesirable partial discharges. The shielding device is embodied, for example, as a Faraday Cup.

Spring-loaded contacts 76, such as a spring-loaded pogo pin, simplify pin alignment and robustness for handling.

The HV connector 17 (lead-lined HV connector) encloses the epoxy 70 and is coupled to the tube casing, the HV connector 17 further includes an HV cable terminal 72.

The HV connector 17 also includes a leadlined housing 78, which is joined to the tube housing 12, such as at an end thereof, is illustrated. The lead-lined Al housing 78 is embodied as including alternate materials, such as aluminum.

The HV cable 28 including electric conductor or conductors 82 positioned along the center of the cable 28, and a layer of HV insulation 80 surrounding conductors 82. As stated above, there may be a single solid conductor 82 or a number of conductors. The HV cable 28 is coupled to the HV cable terminal such that the HV cable contacts the shielding device 74, or alternate conductive means, as will be understood by one skilled in the art.

The HV cable 28 is inserted into the HV connector 17, through an aperture in connector housing 78. The aperture 72 is typically positioned transaxially to axis 87. Conductors 82 extend beyond the end of insulation layer 80, and are directed through tube housing 12 and mated with an electric coupling element 38, joined to cathode 14. The coupling element 38 and cathode 14 are supported in place by insulator 13, inserted into the end of tube 10 and formed of ceramic material or the like.

Conductors 82 typically include copper, and insulation 80 includes a material such as EP rubber. Such material provides the HV cable 28 with flexibility, and at the same time provides sufficient insulation for the high voltage electric power carried thereby.

In operation, the X-ray source is activated and high voltage charge travels through the HV conductor and into the shielding device. Concurrently, the ceramic insulator is minimizing the electric field and potential arc through the unique design described previously.

From the foregoing, it can be seen that there has been brought to the art a new HV system. It is to be understood that the preceding description of the preferred embodiment is merely illustrative of some of the many specific embodiments that represent applications of the principles of the present invention. Numerous and other arrangements would be evident to those skilled in the art without departing from the scope of the invention as defined by the following claims.

What is claimed is:

1. An HV insulator system for a mono-polar X-ray device comprising:

a first side of an insulator, said first side comprising a substantially cone-shaped central portion;

a second side of an insulator defining a flat surface adapted for coupling to an HV connector; and a flanged outer edge of said first side and said second side, said flanged outer edge adapted for coupling to said HV connector;

whereby said first side defines an inverse cone central channel coaxial with said cone-shaped central portion and adapted to receive said HV conductor, and wherein said substantially cone-shaped portion further defines said inverse cone channel such that a base of said inverse cone channel is defined at a tapered apex of said substantially cone-shaped central portion.

2. The system of claim 1 further comprising an HV connector enclosing an epoxy and coupled to said flanged outer edge, said HV connector further comprises an HV cable terminal.

3. The system of claim 2 further comprising an HV cable coupled to said HV cable terminal such that said HV cable contacts said electrical conductor.

4. The system of claim 2 wherein said epoxy surrounds said electrical conductor.

5. The system of claim 4 wherein said epoxy comprises at least one of $Al_2O_3$ powder, AlN powder, BN powder, or gravels of similar materials.

6. The system of claim 4 further comprising a gasket wherein said gasket is compressed between said second side and said epoxy through a compressive force wherein said compressive force is from a spring loaded device.

7. The system of claim 6 wherein said gasket comprises silicone rubber or a substance with similar electrochemical properties to silicone rubber.

8. The system of claim 6 wherein said gasket is tapered.

9. The system of claim 1 wherein both said first side and said second side comprise ceramic or a substance with similar properties to ceramic.

10. The system of claim 1 wherein one of said first side or said second side further define a doughnut-shaped area at a tapered apex of said inverse cone channel.

11. The system of claim 10 wherein said doughnut-shaped area is coated with a metallization layer.

12. An HV system comprising:

a ceramic HV insulator for a mono-polar X-ray device comprising a first side, said first side comprising a substantially cone-shaped central portion, a second side defining a flat surface, and a flanged outer edge of said first side and said second side, whereby said first side defines an inverse cone coaxial with said substantially cone-shaped central portion, said central channel adapted to receive said HV conductor and said substantially cone-shaped portion further defines said inverse cone channel such that a base of said inverse cone channel is defined at a tapered apex of said substantially cone-shaped central portion;

a lead-lined HV connector enclosing an epoxy and coupled to said flanged outer edge, said lead-lined HV connector further comprises an HV cable terminal;

an electrical conductor surrounded by said epoxy; and a gasket compressed between said ceramic HV insulator and said epoxy.

13. The system of claim 12 wherein a gasket is compressed between said ceramic HV insulator and said epoxy through a compressive force wherein said compressive force is from a spring loaded device.

14. The system of claim 13 wherein said gasket is tapered and comprised of silicone rubber or a substance with similar electrochemical properties to silicone rubber.

15. The system of claim 12 wherein said first side further includes multiple circumferential grooves coaxial with said central channel.

16. The system of claim 12 wherein said first side further comprises at least one booster shed.

17. The system of claim 12 wherein said epoxy comprises at least one of $Al_2O_3$ powder, AlN powder, BN powder, or gravels of similar materials.

18. The system of claim 12 wherein one of said first side or said second side further define a doughnut-shaped area at a tapered apex of said inverse cone channel.

19. A method for assembling an HV system for a monopolar X-ray device comprising:

coupling a ceramic insulator to an X-ray device, said ceramic insulator comprising a first side, said first side comprising a substantially cone-shaped central portion, a second side defining a flat surface, which includes at least one HV contact to receive spring-loaded pins from an HV connector, and a flanged outer edge of said first side and said second side, wherein said first side defining an inverse cone central channel and said substantially cone-shaped portion further defining said inverse cone channel such that a base of said inverse cone channel is defined at a tapered apex of said substantially cone-shaped central portion;

compressing a gasket between said ceramic insulator and an epoxy; and coupling a lead-lined HV connector to said ceramic insulator.

20. The method of claim 19 wherein said step of compressing said gasket further comprises compressing said gasket between said ceramic insulator and said epoxy through a compressive force wherein said compressive force is from a spring loaded device.

* * * * *